US011744289B2

(12) United States Patent
Liu

(10) Patent No.: US 11,744,289 B2
(45) Date of Patent: Sep. 5, 2023

(54) ATOMIZATION ASSEMBLY

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 393 days.

(21) Appl. No.: 17/020,782

(22) Filed: Sep. 14, 2020

(65) Prior Publication Data

US 2021/0212371 A1 Jul. 15, 2021

(30) Foreign Application Priority Data

Jan. 15, 2020 (CN) ..... 202010046441.0

(51) Int. Cl.

| | |
|---|---|
| ***A24F 40/46*** | (2020.01) |
| ***A24F 40/10*** | (2020.01) |
| ***A24F 40/40*** | (2020.01) |

(52) U.S. Cl.

CPC ..... *A24F 40/46* (2020.01); *A24F 40/10* (2020.01); *A24F 40/40* (2020.01)

(58) Field of Classification Search

CPC ..... A24F 40/46; A24F 40/10; A24F 40/20

See application file for complete search history.

(56) References Cited

U.S. PATENT DOCUMENTS

2018/0325172 A1* 11/2018 Zhu ..... A24F 47/008
2020/0054074 A1* 2/2020 Liu et al. ..... A24F 47/008

* cited by examiner

*Primary Examiner* — Michael J Felton
*Assistant Examiner* — Ronnie Kirby Jordan
(74) *Attorney, Agent, or Firm* — MATTHIAS SCHOLL P.C.; Matthias Scholl

(57) ABSTRACT

An atomization assembly, including a ceramic core and a stainless-steel tank. The ceramic core includes three or more heating elements connected in parallel. The ceramic core is disposed in the stainless-steel tank.

4 Claims, 3 Drawing Sheets

ATOMIZATION ASSEMBLY

CROSS-REFERENCE TO RELATED APPLICATIONS

Pursuant to 35 U.S.C. § 119 and the Paris Convention Treaty, this application claims foreign priority to Chinese Patent Application No. 202010046441.0 filed Jan. 15, 2020, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an atomization assembly.

A conventional atomization assembly comprises one ceramic core. In addition, the smoke material is directly placed on the heating element of the ceramic core for vaporization. The thermal utilization rate of the heating element leaves much to be desired.

SUMMARY

The disclosure provides an atomization assembly, comprising a ceramic core and a stainless-steel tank; the ceramic core comprises three or more heating elements connected in parallel; and the ceramic core is disposed in the stainless-steel tank.

In a class of this embodiment, the stainless-steel tank comprises a side wall provided with a recess; the ceramic core produces and transmits a heat to the stainless-steel tank through heat transfer to atomize a smoke material in the stainless-steel tank to produce vapor; the stainless-steel tank is provided with an opening, and the vapor flows out of the opening for user's inhaling.

In a class of this embodiment, the atomization assembly further comprises a fixing seat and a cover disposed on two ends of the stainless-steel tank, respectively.

In a class of this embodiment, the atomization assembly further comprises a joint and an insulation ring; the insulation ring is disposed in the fixing seat; and the joint is a hollow structure disposed in the insulation ring for electric conduction and air conduction.

The following advantages are associated with the atomization assembly of the disclosure. The ceramic core of the atomization assembly comprises a plurality of heating elements connected in parallel; they work in the atomization assembly simultaneously with high power and large amount of vapor compared with a conventional atomizer. The stainless-steel tank comprises a side wall provided with a recess. The ceramic core produces and transfers the heat to the recess (a side heating chamber) of the stainless-steel tank to heat the smoke material and produce vapor. The vapor flows out of the opening for user's inhaling.

DETAILED DESCRIPTION

To further illustrate, embodiments detailing an atomization assembly are described below. It should be noted that the following embodiments are intended to describe and not to limit the disclosure.

Smoke materials refer to smoke oil, tobacco, tobacco and other materials used to produce smoke.

Figure 1:
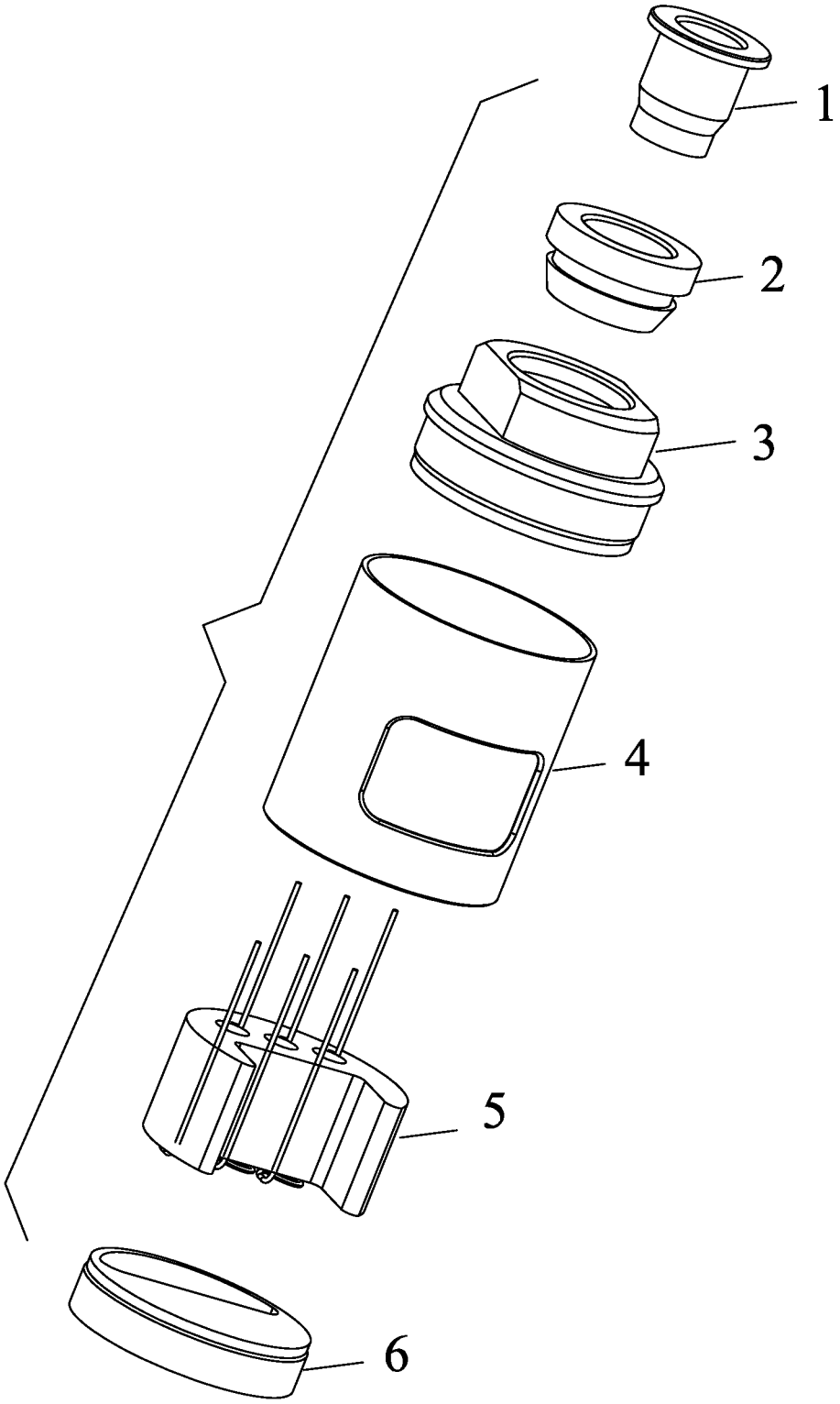
FIG. 1 is an exploded view of an atomization assembly according to one embodiment of the disclosure.
Figure 2:
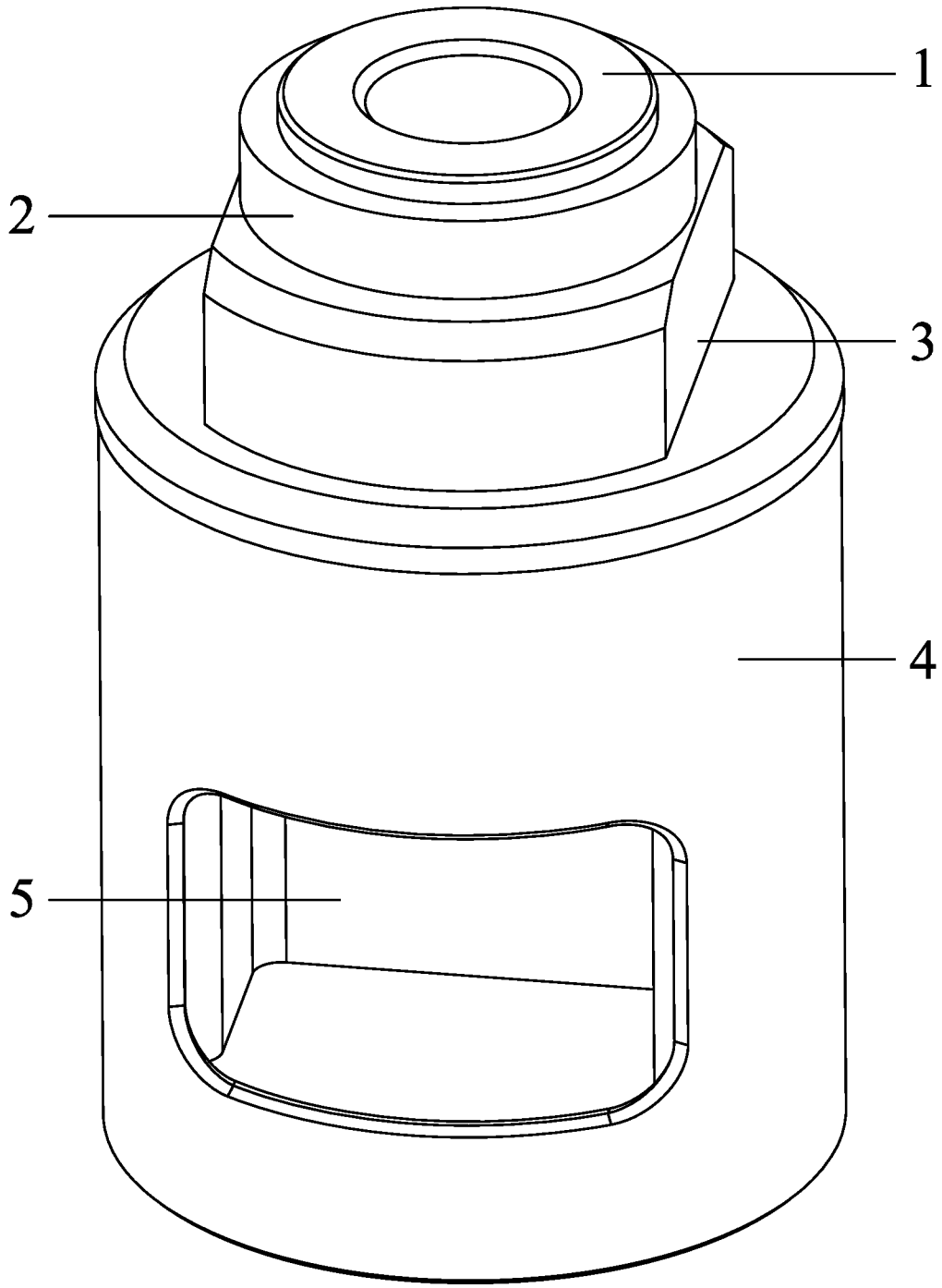
FIG. 2 a schematic diagram of an atomization assembly according to another embodiment of the disclosure.
Figure 3:
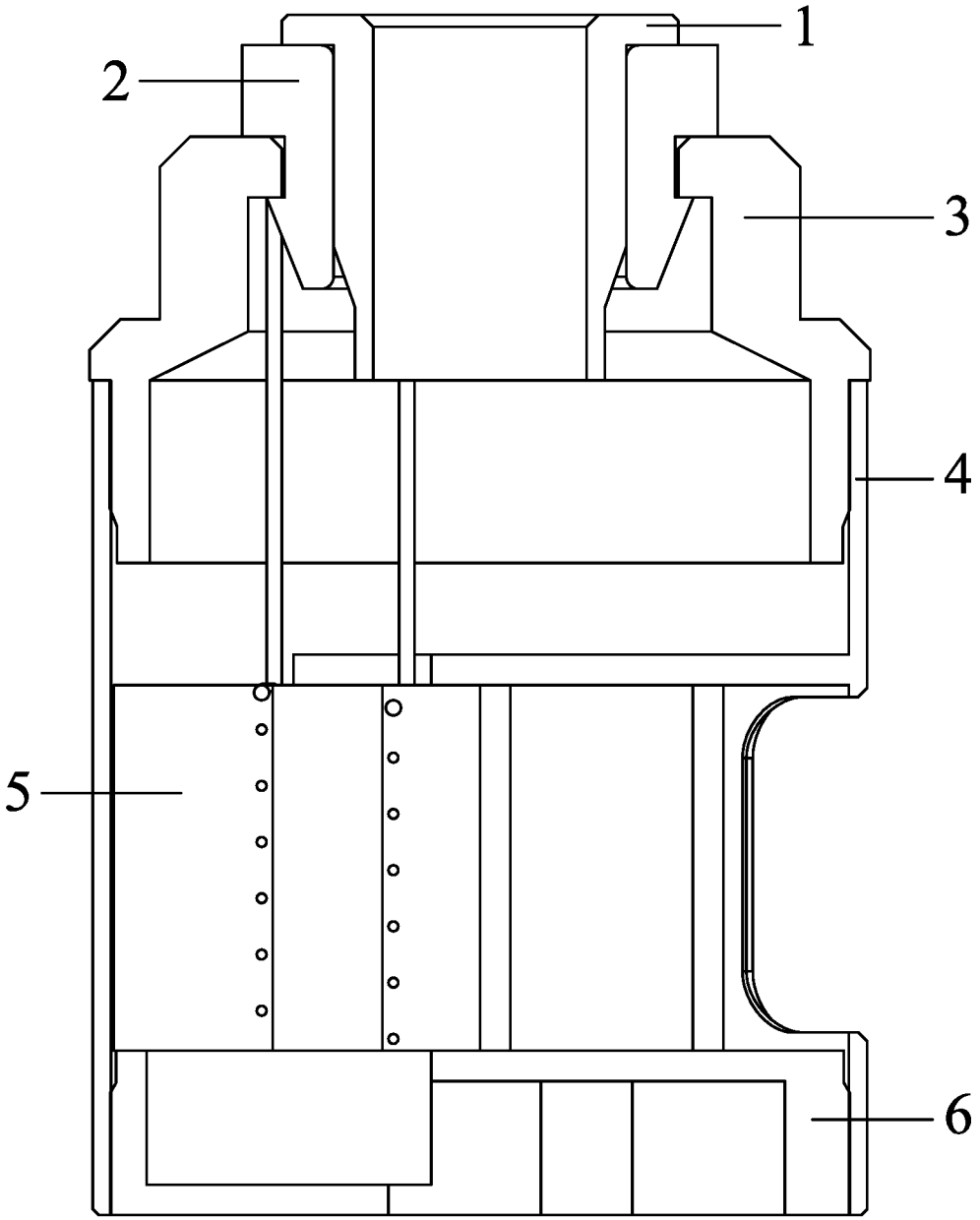
FIG. 3 is a sectional view of an atomization assembly according to one embodiment of the disclosure.

As shown in FIGS. 1-3, an atomization assembly comprises a joint 1, an insulation ring 2, a fixed seat 3, a stainless-steel tank 4, a ceramic core 5, and a cover 6. The ceramic core 5 is disposed in the stainless-steel tank 4 to protect the ceramic core 5 and prevent the ceramic core from dropping, and transfer heat to the stainless-steel tank 4. The fixed seat 3 is disposed on the top end of the stainless-steel tank 4. The insulation ring 2 is disposed in the fixed seat 3 for insulation. The joint 1 is a hollow structure disposed in the insulation ring 2 for electric conduction and air conduction. The cover 6 is disposed on the bottom end of the stainless-steel tank 4 to seal the stainless-steel tank 4.

The following advantages are associated with the atomization assembly of the disclosure:

1. The ceramic core of the atomization assembly comprises a plurality of heating elements connected in parallel; they work in the atomization assembly simultaneously with high power and large amount of vapor compared with a conventional atomizer.

2. The ceramic core produces and transfers the heat to a side heating chamber of the stainless-steel tank to heat the smoke material, which can prevent the ceramic core from dropping, and the stainless-steel tank is easy to clean.

It will be obvious to those skilled in the art that changes and modifications may be made, and therefore, the aim in the appended claims is to cover all such changes and modifications.

What is claimed is:

1. An atomization assembly, comprising a ceramic core and a stainless-steel tank; wherein:

the ceramic core comprises three or more heating elements connected in parallel; and the ceramic core is disposed in the stainless-steel tank;

the stainless-steel tank comprises a cylindrical side wall and is adapted for receiving a smoke material;

the ceramic core is adapted for producing and transmitting heat to the stainless-steel tank so as to atomize the smoke material in the stainless-steel tank and produce vapor;

the ceramic core comprises an indentation;

a portion of the cylindrical side wall of the stainless-steel tank is bent inwardly, whereby the cylindrical side wall of the stainless-steel tank has a recess; and the portion of the cylindrical side wall of the stainless-steel tank is disposed in the indentation of the ceramic core.

2. The atomization assembly of claim 1, wherein the stainless-steel tank is provided with an opening, and the vapor flows out of the opening for user's inhaling.

3. The atomization assembly of claim 2, further comprising a fixing seat and a cover disposed on two ends of the stainless-steel tank, respectively.

4. The atomization assembly of claim 3, further comprising a joint and an insulation ring, wherein the insulation ring is disposed in the fixing seat; and the joint is a hollow structure disposed in the insulation ring for electric conduction and air conduction.

* * * * *